United States Patent [19]

Lee

[11] 4,284,213

[45] Aug. 18, 1981

[54] CLOSURE AND NOZZLE SYSTEM FOR CONTAINER FOR AIR-CURABLE MATERIAL

[75] Inventor: Headie O. Lee, Midland, Mich.

[73] Assignee: Dow Corning Corporation, Midland, Mich.

[21] Appl. No.: 166,006

[22] Filed: Jul. 7, 1980

[51] Int. Cl.[3] ..... B65D 47/10

[52] U.S. Cl. ..... 222/541; 220/288; 220/266; 222/539

[58] Field of Search ..... 220/288, 266, 265; 222/541, 539

[56] References Cited

U.S. PATENT DOCUMENTS

| | | | |
|---|---|---|---|
| 3,308,998 | 3/1967 | Oppasser et al. | 222/539 |
| 3,419,172 | 12/1968 | Lee | 222/541 |
| 3,743,144 | 7/1973 | Marg et al. | 222/541 X |

*Primary Examiner*—G. T. Hall

*Attorney, Agent, or Firm*—Howard W. Hermann

[57] ABSTRACT

An improved closure and nozzle system for containers for air-curable materials such as cartridges for sealant and caulking compounds is disclosed. A container such as a caulking cartridge is provided with a threaded neck for attachment of a correspondingly threaded nozzle having a tapered tip portion designed to be cut off to provide a desired orifice size. A cap having a snap-fit ring is designed to mate with a corresponding snap-fit ring on the nozzle short of the tip and also having a threaded external portion designed to mate with the container neck so that the cartridge can be resealed after opening.

2 Claims, 4 Drawing Figures

CLOSURE AND NOZZLE SYSTEM FOR CONTAINER FOR AIR-CURABLE MATERIAL

BACKGROUND OF THE INVENTION

The present invention relates to closure systems and dispensing nozzles for containers for air-curable compositions and is particularly directed toward resealable caulking cartridges.

For many years there have been available caulking guns for providing sealant bonds in building construction or the like. Such guns make use of disposable tubular cartridges which contain a liquid caulking compound or sealant. A piston applies pressure to the rear portion of the cartridge which acts as a piston to force sealant out of a nozzle at the front of the cartridge.

Many modern sealants are designed to cure upon contact with air such as for example by reacting with water vapor in the air to form a rigid or semi-rigid mass to seal the area to which the liquid has been applied. In order to prevent curing of the material in the cartridge prior to use the cartridges are factory sealed and typically a tapered nozzle having a closed end is provided on the cartridge. When made ready for use the nozzle tip is cut off at a point along the taper which provides the desired orifice size for dispensing the sealant.

One of the greatest aggravations to the user of these devices is the inability to reseal the cartridges after partial use, resulting in waste of the remainder of the cartridge. The cut end of the nozzle allows air to enter the exposed sealant causing it to cure first in the nozzle and gradually into the cartridge. To partially alleviate this problem some sealant cartridges are made with threaded necks and a screw-on nozzle having mating threads. After short term storage the nozzle can be unthreaded from the cartridge and the cured plug of sealant pushed out of the back end of the nozzle by pressure applied through the cut off end. However, if curing has progressed beyond the nozzle into the cartridge re-use becomes almost impossible.

SUMMARY OF THE INVENTION

The primary object of this invention is to provide an improved nozzle and closure system for containers for air-curable compositions.

More particularly the invention is aimed at providing a nozzle and closure assembly which can be conveniently resealed after use of part of the contents and is provided with a convenient semisealing provision for short term nonuse.

In accordance with these and other objects there is provided by the present invention an improved nozzle and closure system which makes use of a container having a threaded neck for attachment of a dispensing nozzle. The system further includes a replaceable cap which can be placed over the cut open end of the cartridge for short term storage, for example, overnight, and which can be reversed and threaded into the cartridge in place of the nozzle for long term sealing of a partially emptied container. Desirably the cap and nozzle are provided with a snap-fit interconnection so that the cap is retained on the nozzle tip and provides sufficient sealing to protect the contents for short term nonuse after the nozzle tip has been cut off.

BRIEF DESCRIPTION OF THE DRAWINGS

Other objects and advantages of the invention will become obvious to those skilled in the art by reading the following detailed description in connection with the accompanying drawings wherein.

DESCRIPTION OF THE PREFERRED EMBODIMENTS

Figure 1:
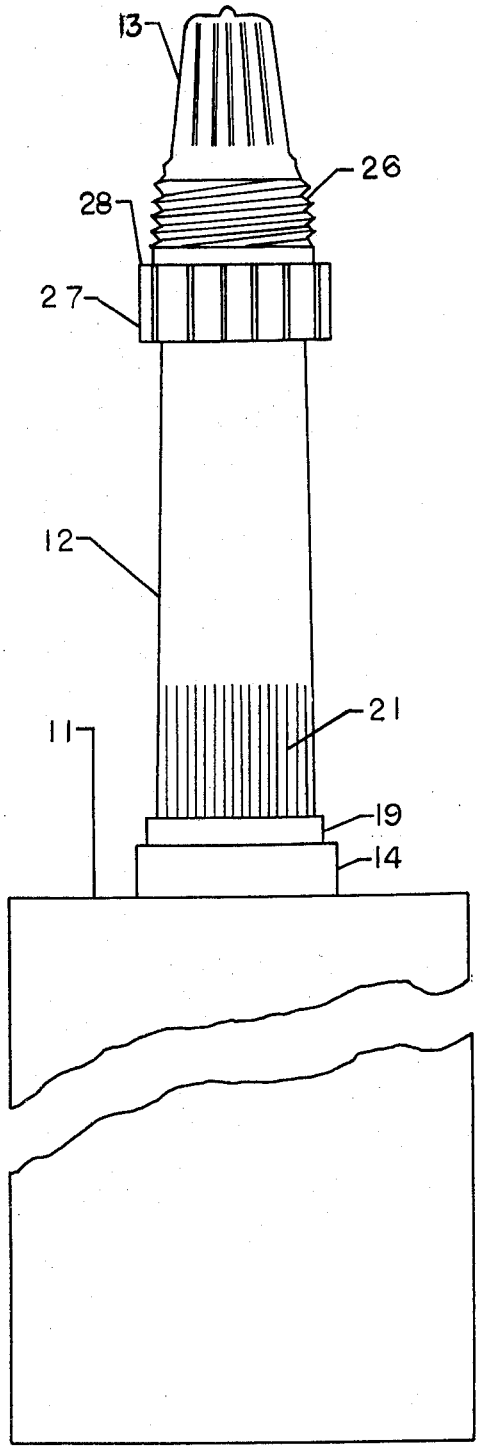
FIG. 1 is a side view in elevation of a sealant cartridge fitted with an embodiment of the present invention.
Figure 2:
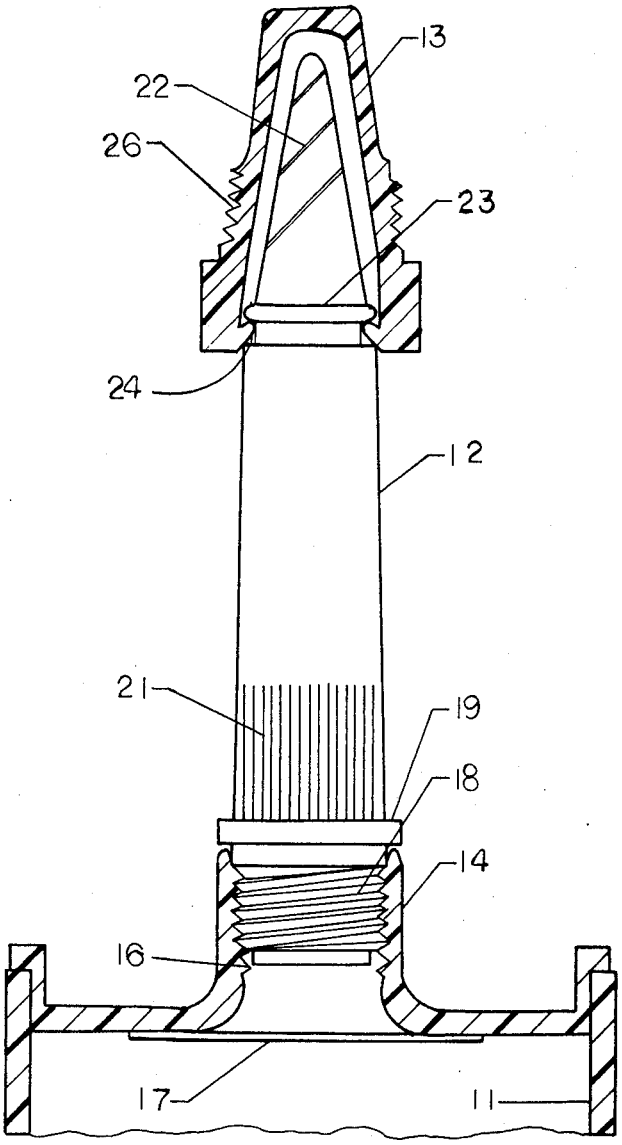
FIG. 2 is a partial axial cross-section of the embodiment shown in FIG. 1 showing the nozzle in elevation.

Referring now to the drawings wherein like reference characters designate like parts throughout the figures thereof there is shown in FIG. 1 a container such as a caulking cartridge 11 having a dispensing nozzle 12 and a cap 13 mounted thereon. As may be seen more clearly from FIG. 2 the cartridge 11 has a neck 14 having internal threads 16 and typically the neck is sealed by a rupturable foil patch 17. The cartridge shown is conventional and forms no part of the present invention except that the threaded neck is a necessity to its function as will be described hereinafter.

The nozzle 12 has a threaded portion 18 on its inner end designed for attachment to neck 14 of the cartridge 11 by mating with the cartridge neck threads 16. A flange or shoulder 19 is preferably provided on the nozzle adjacent the threaded portion 18 for abutting the end of the neck 14 of the cartridge to provide sealing engagement therewith. A knurled portion 21 is also preferably provided on the nozzle for ease in gripping the nozzle to facilitate detachment by unscrewing the nozzle from the cartridge neck.

Figure 3:
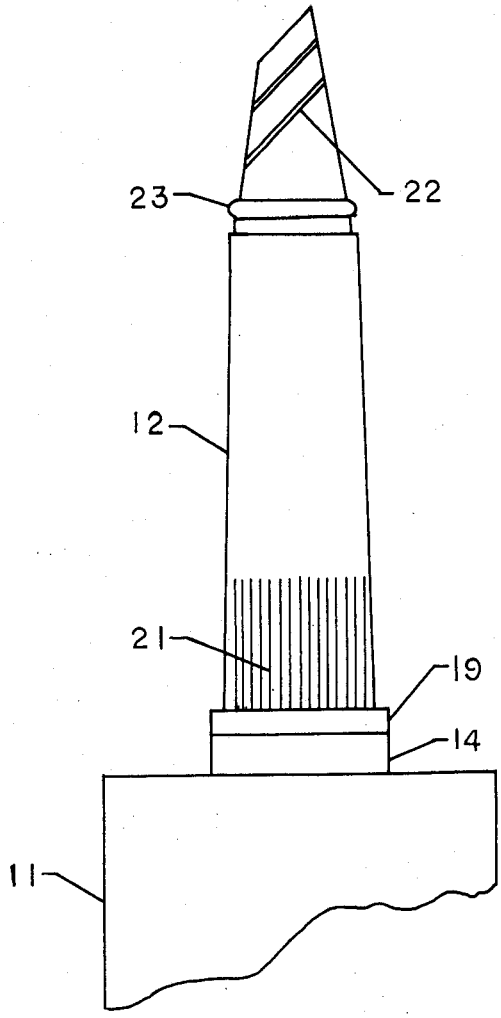
FIG. 3 is a partial view in elevation of the embodiment of FIGS. 1 and 2 showing the nozzle tip cut off for extrusion of the cartridge contents.

The nozzle is provided at its outer end with a tapered portion preferably marked by indicia 22. The tip of the nozzle is closed until cut off at a desired location as shown in FIG. 3 and the indicia 22 are provided as guides for cutting at the proper angle. After the nozzle tip is cut off, pressure applied to the foil seal 17 will cause it to rupture and the cartridge is ready for use.

The nozzle 12 is preferably further provided with a snap-fit ring 23 molded thereon adjacent the tapered tip portion and designed to mate with a corresponding snap-fit ring 24 molded on the interior of the cap 13 for interlocking therewith. Alternatively, the cap interior can simply be dimensioned for a press-fit on the tapered end of the nozzle 12. The snap-fit configuration, however, provides for a positive interlock between cap and nozzle so that the cap is relatively tightly secured and is not easily lost or accidentally loosened. The cap 13 thereby forms a semi-seal with the nozzle to prevent serious deterioration of the contents of the cartridge during short term nonuse after opening. For example, the cap may be replaced during a lunch break or overnight with most materials without allowing enough air to enter the nozzle to cause problems.

Figure 4:
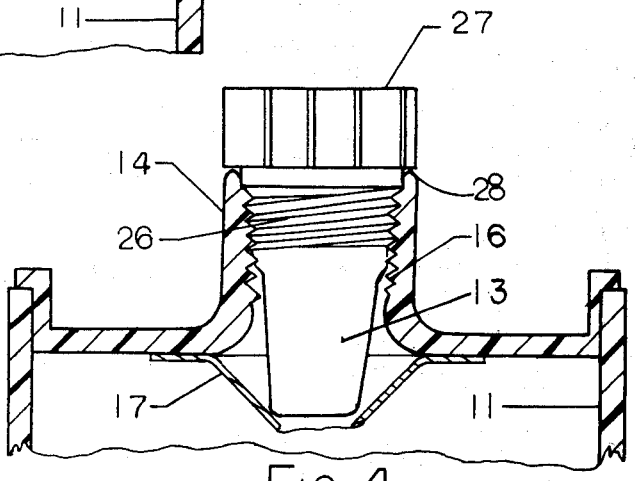
FIG. 4 is a partial axial cross-section of the embodiment shown in FIGS. 1–3 with the cap shown in place to reseal the cartridge.

For longer term storage the cap 13 is further provided with an external threaded portion 26 designed to mate with the threaded portion 16 of the neck 14 of the cartridge 11. A knurled portion 27 formed with a shoulder 28 adjacent the threaded portion is designed for ease in tightening the cap into the neck threads until the shoulder 28 abuts the end of the cartridge neck in sealing relationship. For long term storage, then, the nozzle is removed by unscrewing it from the neck of the cartridge and screwing the cap 13 into the neck of the cartridge to seal the contents against contact with air as shown in FIG. 4. If desired, the nozzle 12 may be inserted into the open end of the cap for storage so that it is not lost.

When re-use is desired the plug of cured material which has been formed in the nozzle can be pushed out of the cartridge, the cap in the neck replaced by the nozzle, and the system is again ready for further use.

Other modifications and variations of the invention will become obvious to those skilled in the art from a reading of the foregoing. It is to be understood therefore that within the scope of the claims the invention may be practiced otherwise than as specifically described.

That which is claimed is:

1. In a closure system for a container for air-curable materials, said container comprising a threaded neck for attachment of a dispensing nozzle having threads adapted to mate with the threads on said neck, said nozzle further including a tapered normally closed tip portion designed to be cut off at a point along a portion of its length to provide a desired nozzle orifice size, the improvement which comprises a hollow cap having an external threaded portion also designed to mate with the threads on said neck of said container and having interconnection means formed on an interior surface thereof designed to cooperate with corresponding interconnection means formed on the exterior surface of said nozzle at a point short of the nozzle portion which is designed to be cut off, whereby the cap can be affixed over the nozzle during short term nonuse or in place of the nozzle can be threadedly attached to the neck of said container during long term nonuse to seal the contents against exposure to air thereby extending the useful life of the remaining contents of the container.

2. The improvement defined in claim 1 wherein the interconnection means on said cap and corresponding interconnection means on said nozzle consist of snap-fit rings formed on corresponding surfaces of the cap and nozzle.

* * * * *